US007899380B2

(12) United States Patent
Suzuki et al.

(10) Patent No.: US 7,899,380 B2
(45) Date of Patent: Mar. 1, 2011

(54) IMAGE FORMING APPARATUS HAVING FIXING DEVICE AND CONTROLLER TO EXECUTE A CLEANING MODE

(75) Inventors: Chikatsu Suzuki, Tokyo (JP); Kenji Taki, Tokyo (JP); Fusako Akimoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 304 days.

(21) Appl. No.: 11/957,532

(22) Filed: Dec. 17, 2007

(65) Prior Publication Data

US 2008/0199197 A1 Aug. 21, 2008

(30) Foreign Application Priority Data

Feb. 20, 2007 (JP) ..... 2007-040044
Oct. 30, 2007 (JP) ..... 2007-281267

(51) Int. Cl.
*G03G 15/20* (2006.01)

(52) U.S. Cl. ..... 399/327; 399/67

(58) Field of Classification Search ..... 399/322, 399/332, 329, 68, 67, 327
See application file for complete search history.

(56) References Cited

U.S. PATENT DOCUMENTS 4,265,198 A * 5/1981 Shinohara et al. ..... 399/67
4,716,435 A * 12/1987 Wilson ..... 399/332
5,087,947 A * 2/1992 Torino ..... 399/322
5,111,250 A * 5/1992 Kashiwagi ..... 399/332
5,138,379 A * 8/1992 Kanazashi ..... 399/67
5,708,926 A * 1/1998 Sagara et al. ..... 399/329
6,731,901 B2 * 5/2004 Nishitani et al. ..... 399/329
7,120,370 B2 * 10/2006 Watabe ..... 399/67
2002/0031361 A1 * 3/2002 Shiiya ..... 399/68
2002/0051650 A1 * 5/2002 Ando et al. ..... 399/67
2003/0128994 A1 * 7/2003 Holubek et al. ..... 399/67
2004/0091295 A1 * 5/2004 Nakamura et al.
2006/0056886 A1 * 3/2006 Ohishi et al. ..... 399/322
2006/0067753 A1 * 3/2006 Katayanagi ..... 399/329

FOREIGN PATENT DOCUMENTS

JP 11-344895 A 12/1999
JP 2003-274151 9/2003
JP 2004-170945 A 6/2004
JP 2006-84677 A 3/2006

OTHER PUBLICATIONS

Office Action for Japanese Patent Application 2007-281267 with English translation mailed Jan. 20, 2009.

* cited by examiner

*Primary Examiner*—Susan S Lee
(74) *Attorney, Agent, or Firm*—Cantor Colburn LLP

(57) ABSTRACT

An image forming apparatus which forms an image on a sheet, includes a controller which executes a cleaning mode in which the controller conveys the sheet from a sheet feed tray to a fixing device without forming a toner image on the sheet, removes toner that has been adhered to a fixing member to clean. In case the cleaning mode is executed, the controller controls a releasing section to release pressure contact of a pressing member before a leading edge of the sheet in a sheet conveyance direction reaches a nip portion between the fixing member and the pressing member, and to bring the pressing member into pressure contact with the fixing member after the leading edge of the sheet has passed through the nip portion.

6 Claims, 11 Drawing Sheets

FIG. 5 ( b )
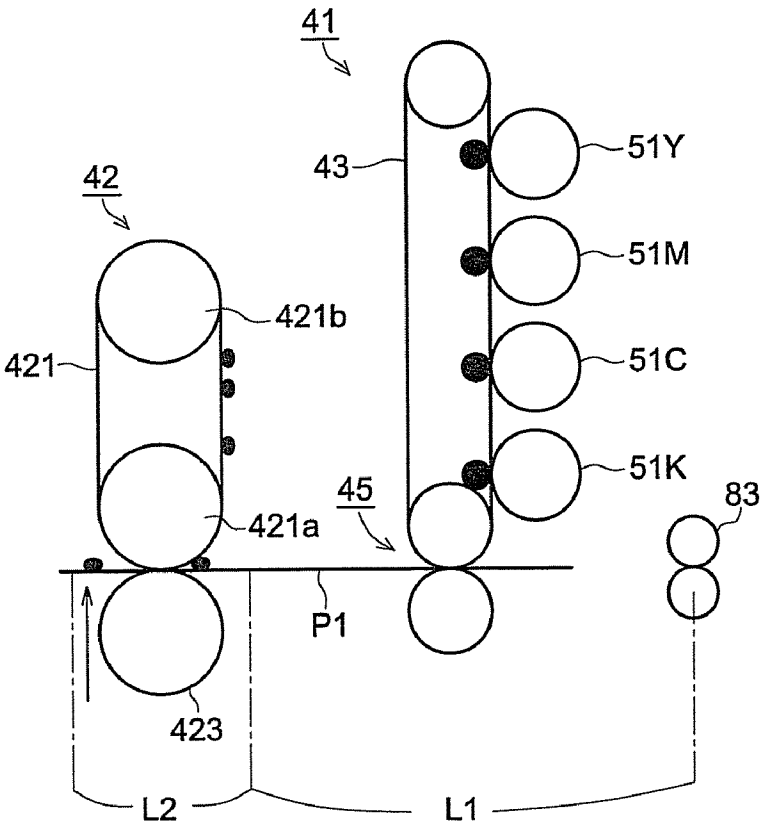
FIG. 5 ( a )
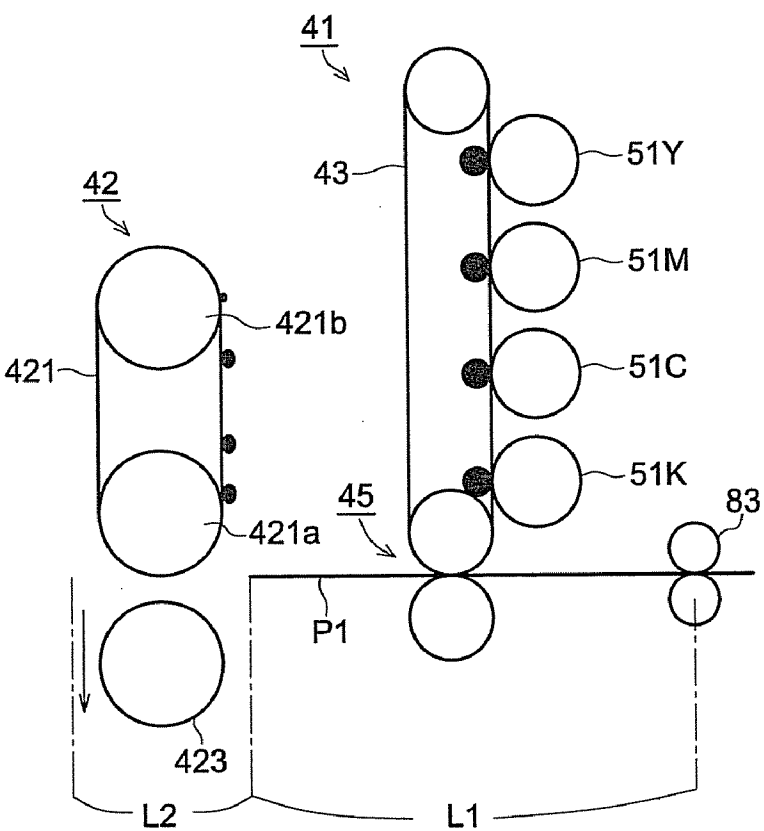

IMAGE FORMING APPARATUS HAVING FIXING DEVICE AND CONTROLLER TO EXECUTE A CLEANING MODE

This application is based on Japanese Patent Application Nos. 2007-040044 filed on Feb. 20, 2007, and 2007-281267 filed on Oct. 30, 2007, which are incorporated hereinto by reference.

BACKGROUND OF THE INVENTION

The present invention relates to a technology for conducting cleaning of a fixing device for fixing a toner image onto the sheet in the image forming apparatus, such as a printer, a copier and a facsimile machine of an electro-photographic system.

An image forming apparatus of an electro-photographic system transfers a toner image onto a sheet and the toner image is fixed onto the sheet by heating with the fixing device.

On this image forming process, there is a case that a sheet jam is generated as a sheet gets stuck in the fixing device. FIG. 9 illustrates the situation of occurrence of sheet jam in the fixing device. FIG. 9 illustrates a schematic cross sectional view showing the sheet P, which generates the jam in the printer section in the image forming apparatus and in the fixing section of the printer.

As illustrated in FIG. 9, a printer section 40 includes an image forming section 41 and a fixing device 42. The image forming section 41 includes photoreceptor drums 51Y, 51M, 51C and 51K and an intermediate transfer belt 43, which is stretched around rollers. A secondary transfer member 45 conducts a secondary transfer of the toner image onto the sheet in the secondary transfer position D. The fixing device 42 includes a fixing member and a pressing member. The fixing member is configured by a fixing roller 421*a*, a stretching roller 421*b* and a fixing belt 421 strained. A pressing roller 423 is utilized as a pressing member.

The image forming apparatus forms an electrostatic latent image on the photoreceptor drums 51Y, 51M, 51C and 51K by irradiating a laser beams thereon and forms a toner image by developing the electrostatic latent image using developer. Then, this toner image will be transferred (a primary transfer) onto the intermediate transfer belt 43. The toner image on the intermediate transfer belt 43 arrives at the secondary transfer position D by a drive of the intermediate transfer belt 43. The toner image arrived at the secondary transfer position D will be transferred (the secondary transfer) onto a sheet P. The toner image, which has been transferred onto the sheet P but has not been fixed yet, is transferred to the fixing device 42 and the toner image is fixed onto the sheet P with heat and pressure. After that, the sheet P, onto which the image has been formed, will be ejected from the apparatus.

On the image forming process described above, as illustrated in FIG. 9, there is a case that the sheet P is wound in the fixing device 42 and sheet jam occurs. In case when the sheet P is stopped by the sheet jam under a fixing process, there is a case that the toner, which has been fixed once onto the sheet, is melted by the heat of the fixing belt 421, retransferred and fixed onto the fixing belt 421. The residual toner remaining on the fixing belt 421 becomes toner dirt of the fixing device 42.

This residual toner remains fixed onto the fixing belt 421, and arrives at the nip portion of the fixing belt 421 and a pressing roller 423 by the rotation of the fixing belt 421. Then the heat of the fixing device 42 melts the residual toner. The melted toner will be fixed onto the sheet, which is processed in the next operation and generates the toner dirt on the image.

In order to resolve the toner dirt, cleaning of the fixing device is necessary. However, the temperature of the fixing device is very high and there is a case that the cleaning by an operator is at risk.

Thus, an image forming apparatus having a fixing device with a cleaning mechanism, such as a cleaning blade, has been proposed. However, in case that the cleaning mechanism has been provided in the fixing device, the fixing belt is worn out and deteriorated due to the cleaning by the cleaning mechanism, and there is a possibility that belt durability is lost. Further, in case when the cleaning mechanism is provided in the image forming apparatus, the manufacturing process of the image forming apparatus becomes complicated and the cost of the image forming apparatus increases.

Thus, the cleaning of the fixing device needs to be safe without newly providing the cleaning mechanism. From this viewpoint, in the conventional image forming apparatus as illustrated in FIG. 10, a cleaning mode has been provided for cleaning a fixing device by sheet feeding a white sheet of paper. Here, the cleaning mode in the conventional image forming apparatus will be described by using FIG. 10.

FIG. 10 illustrates a schematic cross sectional view showing a situation where a sheet feeding is conducted by a cleaning mode executed in the printer in the conventional image forming apparatus. As illustrated in FIG. 10, a blank image is formed on the photoreceptive drums 51Y, 51M, 51C and 51K without forming a toner image, so that the no toner image is transferred to a sheet at the secondary transfer position D. Based on this arrangement, the sheet P will be conveyed to the fixing device 42 in a blank sheet state, onto where the toner image has not been transferred at the secondary transfer position D.

Next, the fixing device 42 executes fixing same as the normal image formation, against the sheet P having arrived to the nip portion. In this case, the residual toner adhered onto the fixing belt 421 is melted at the nip portion and retransferred and fixed onto the blank sheet P. As a result, the force to be adhered to the sheet P becomes larger than the force to be adhered onto the fixing belt 421. Further, an exfoliation force due to the stiffness force of the sheet P is added to the force to be adhered to the sheet P and the toner exfoliates from the fixing belt 421. Thus, as illustrated in FIG. 10, the cleaning of the toner dirt on the fixing belt 421 can be executed. This technology has been disclosed in Unexamined Japanese Patent Application Publication No. 2003-274151.

However, according to the sheet feed based on the execution of the cleaning mode in the image forming apparatus disclosed in Unexamined Japanese Patent Application Publication No. 2003-274151, as illustrated in FIG. 9, there is a case that the leading edge of the sheet P is adhered onto the fixing belt 421 due to the melted toner having a large adhesiveness and be wound in the fixing belt 421. In this case, sheet jam due to the residual toner occurs. The situation of the sheet jam due to the residual toner will be explained by utilizing FIG. 11. FIG. 11 illustrates a schematic cross sectional view wound by the printer section of the image forming apparatus and the fixing device of the printer.

Namely, normally, even when the melted toner, as illustrated in FIG. 10, is adhered onto both of the fixing belt 421 and the sheet P, based on the adhesive force onto the sheet P and the exfoliation force due to the stiffness of the sheet P itself, the toner exfoliates from the fixing belt 421 and the sheet P is conveyed into the conveyance direction (x direction in FIG. 10). However, as illustrated in FIG. 11, in case when the melted residual toner is adhered onto the leading edge of the sheet P, which is wound to the fixing belt 421 through the residual toner causing sheet jam as illustrated in FIG. 9.

In case when sheet jam occurs in the sheet feed of the cleaning mode, the toner dirt of the fixing device is not resolved and the sheet feed needs to be executed again, which makes the cleaning mode complicated. Further, the efficiency of the sheet feed by the cleaning mode decreases.

With respect to the sheet jam in the sheet feed in a conventional cleaning mode, in order that the sheet is not wound on the fixing belt 421, it is thought that a dedicated cleaning sheet be used to avoid the sheet from being wound. However, every time when executing a cleaning mode, the dedicated cleaning sheet has to be set, which makes the cleaning of the fixing device complicated.

SUMMARY OF THE INVENTION

It is therefore an object of the present invent is to safely and simply execute cleaning of a fixing device in the image forming apparatus without deterioration of the fixing device and increase in manufacturing cost of the image forming apparatus.

In order to solve the problems described above, in accordance with one aspect of the present invention, an image forming apparatus for forming an image onto a sheet, is provided with an image forming section for forming a toner image onto the sheet, a fixing device including a fixing member, a pressing member contacting the fixing member and releasing section for pressing and releasing the pressing member to or from the fixing member, and fixing the toner image onto the sheet by applying heat and pressure at a nip portion of the fixing member and the pressing member, a registration roller for feeding the sheet to a secondary transfer position in a downstream of a conveyance direction, and a controller for controlling an execution of a cleaning mode and the conveyance of the sheet P, in which the controller conveys the sheet from a sheet feed tray to the fixing device without forming the toner image onto the sheet and removes toner adhered onto the fixing member, wherein the controller controls the pressing member so as to release a contact to the fixing member before a leading edge of the sheet arrives to the nip portion, and press and contact the fixing member after the leading edge of the sheet has passed through the nip portion.

BRIEF DESCRIPTION OF THE DRAWINGS

FIGS. 5(*a*)-5(*b*) illustrate an execution control of a cleaning mode of the image forming apparatus pertaining to the embodiment of the present invention.

DETAILED DESCRIPTION OF THE PREFERRED EMBODIMENT

[Structure]

Image forming apparatuses, such as, a printer, which is capable of outputting color images, and a color multifunction peripheral including a copier and a facsimile machine, will be described as embodiments of the present invention.

Figure 1:
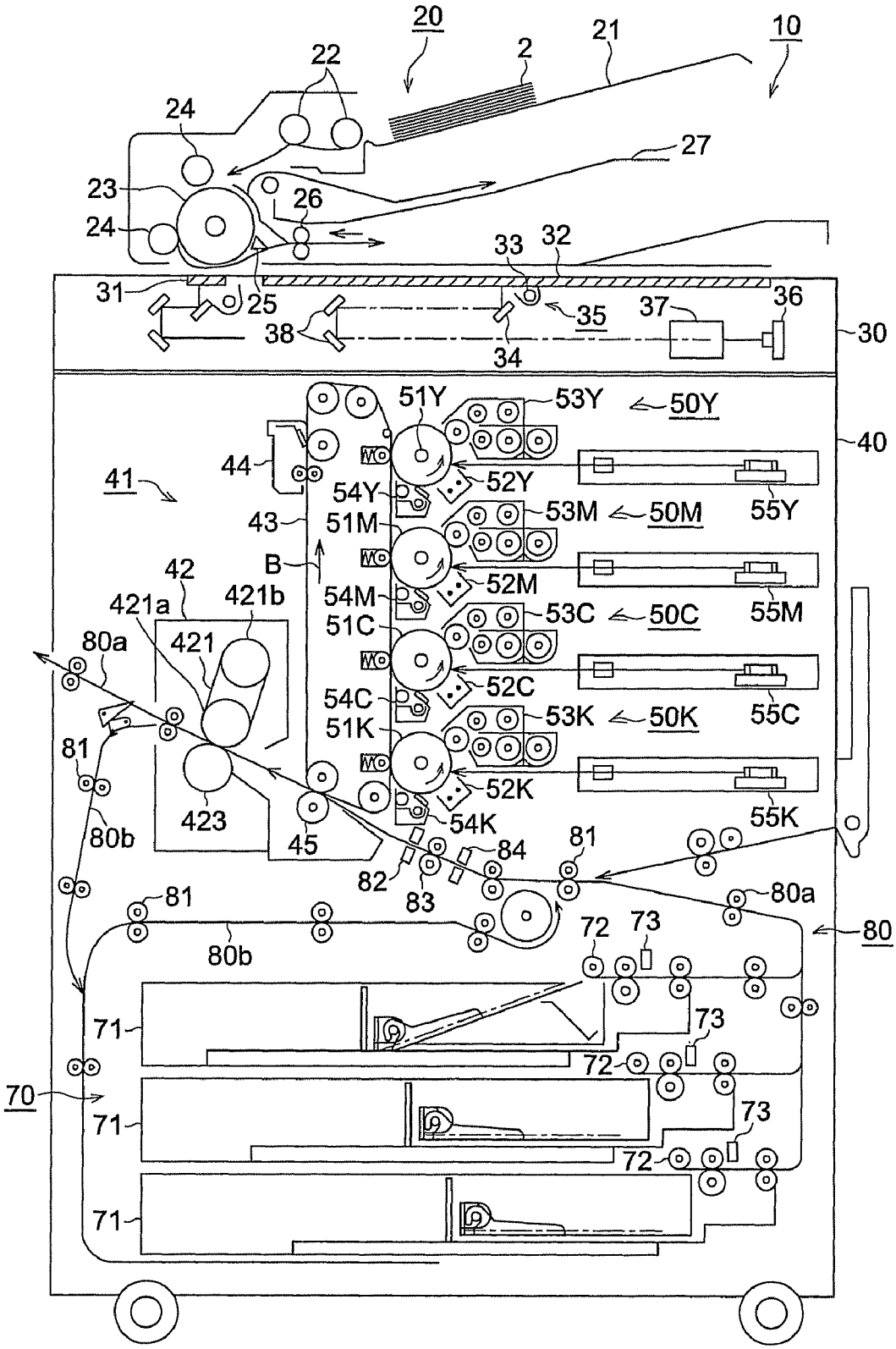
FIG. 1 illustrates a schematic structure of an image forming apparatus of an embodiment of the present invention.
Figure 2:
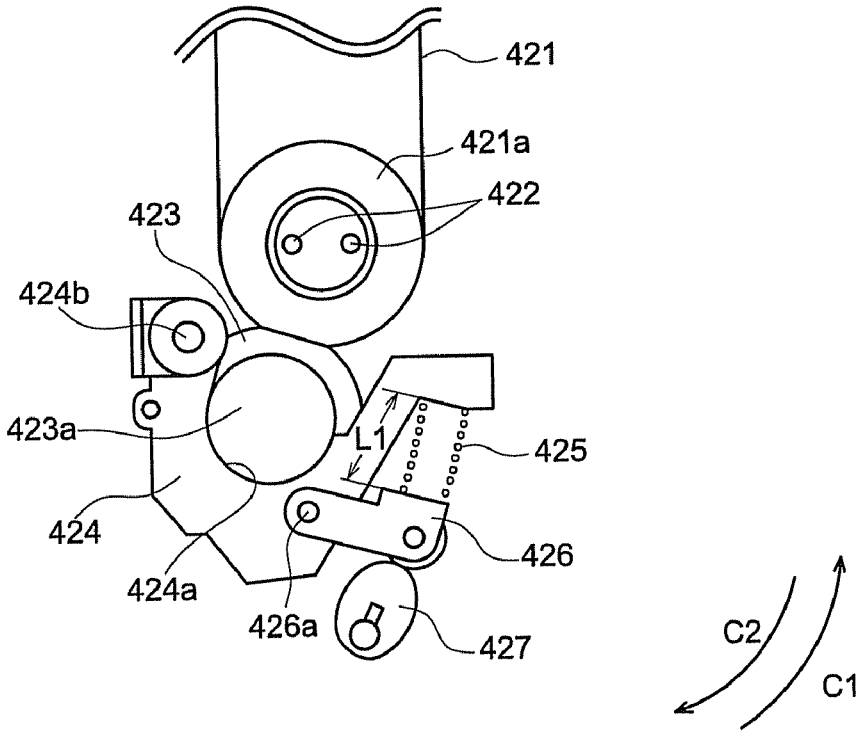
FIGS. 2(*a*)-2(*b*) illustrate schematic drawings of the fixing device of the image forming apparatus pertaining to the embodiment of the present invention.
Figure 2:
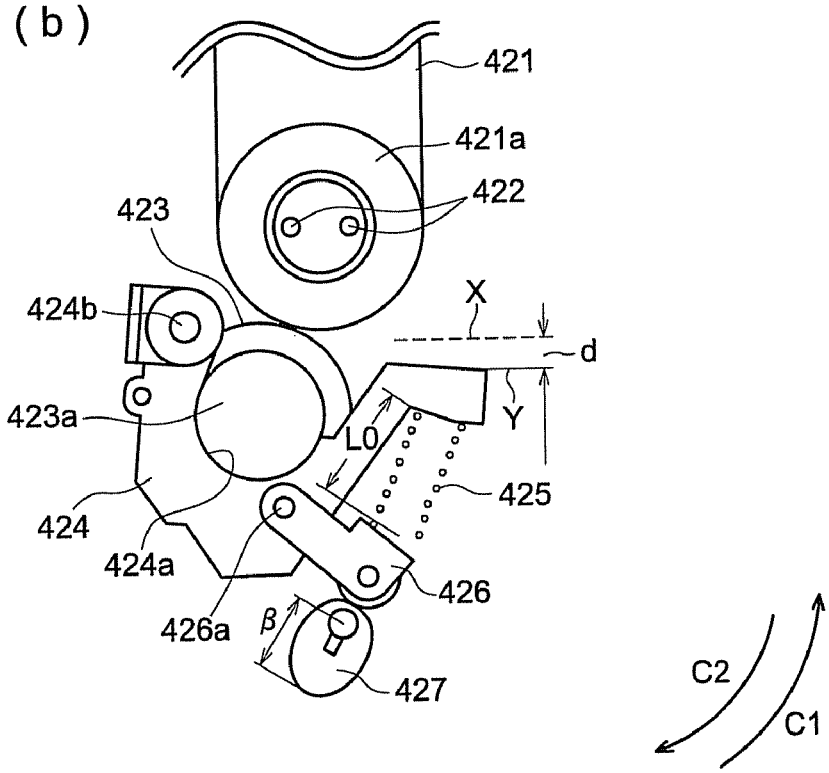
Figure 3:
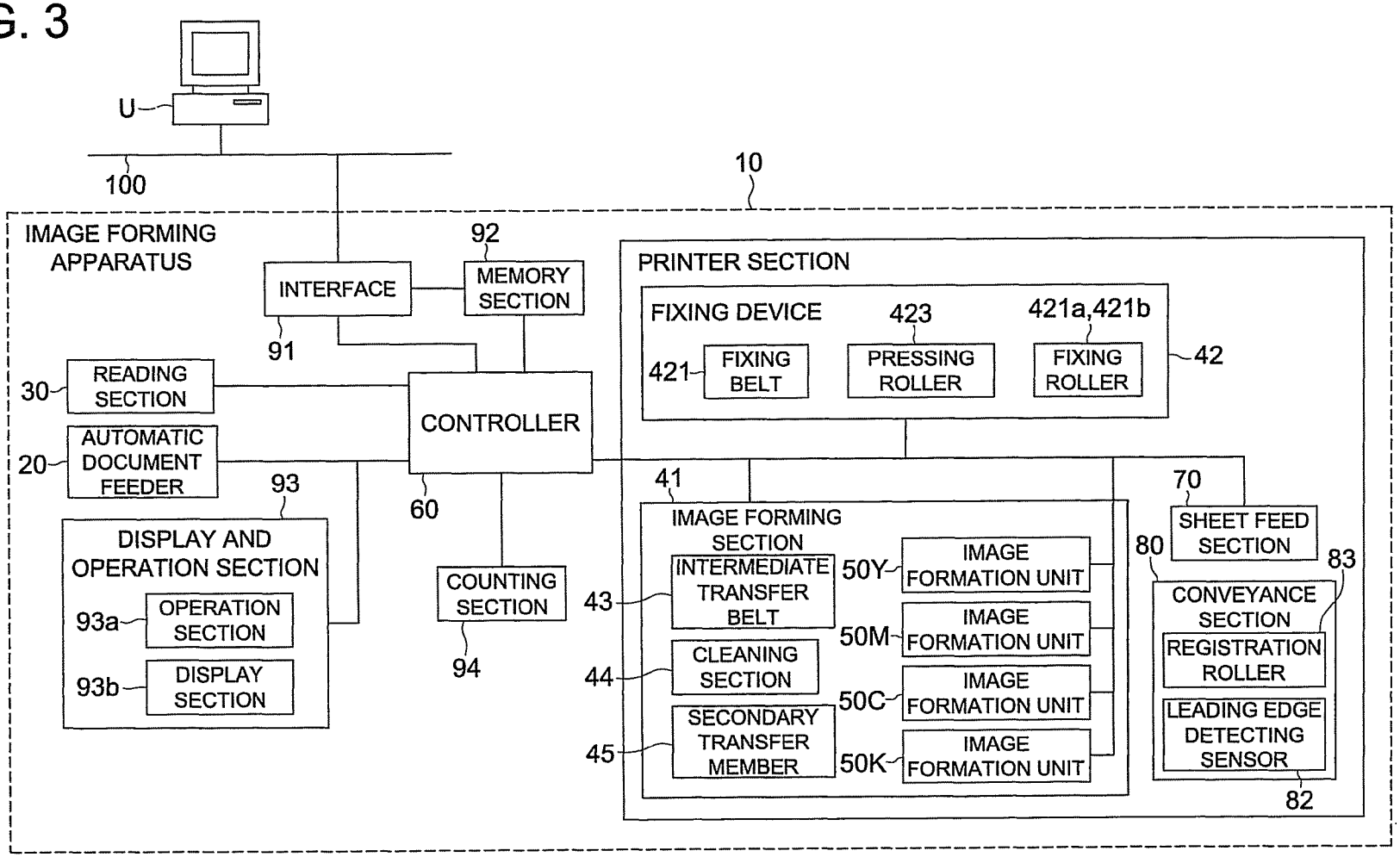
FIG. 3 illustrates a block diagram showing a schematic structure of the image forming apparatus pertaining to the embodiment of the present invention.

The structure of an image forming apparatus 10 will be described by referring to FIGS. 1-3. FIG. 1 illustrates a schematic structure of the image forming apparatus 10 of an embodiment of the present invention. FIGS. 2(*a*)-2(*b*) illustrate schematic drawings of a fixing device 42 of the image forming apparatus 10 pertaining to the embodiment of the present invention. FIG. 2(*a*) illustrates a pressure-contact state and FIG. 2(*b*) illustrates a pressure-contact release state. FIG. 3 illustrates a block diagram of a schematic structure of control of the image forming apparatus 10 pertaining to the embodiment of the present invention.

[Image Forming Apparatus]

As illustrated in FIG. 1, the image forming apparatus 10 includes an automatic document feeder 20, a reading section 30 and a printer section 40. The image forming apparatus is arranged to execute a sheet feed of a blank sheet of paper in the cleaning mode for cleaning residual toner adhered on the fixing device. In case when executing the cleaning mode, a controller 60 switches the fixing device 42 into a pressure-contact state. The structure of each section of the image forming apparatus 10 will be described hereinafter.

The automatic document feeder 20 conveys documents 2 stacked on the document tray 21 one by one to a reading section 30 and ejects the document after having read to a sheet ejection tray 27. Further, in case when the documents 2 are a dual surface document, the documents 2, of which one surface has been read, is reversed front and back by a reversing roller 26 and conveyed to the reading section 30 again.

The automatic document feeder 20 includes a sheet feed roller 22 for feeding a sheet from the top portion of the documents 2 placed on a document tray 21, a conveyance roller 23 for conveying the document 2 onto the slit glass 31 located in the reading position and a guide roller 24 for conveying the document 2 along the conveyance roller 23. Further, the automatic document feeder 20 includes a switching claw 25 for switching the moving direction of the document 2 passing through on the slit glass 31 and an ejection tray 27, onto which a read document 2 is ejected.

The reading section 30 has a function for reading a color image of the document 2. The reading 30 is arranged to optically read the document 2 by diving three colors of Red (R), Green (G) and Blue (B), and converts the read image data into four color density data of Yellow (Y), Magenta (M), Cyan (C) and Black (K) and respectively output the image data of the four colors.

The reading section 30 includes an exposure and scanning section 35 configured by a light source 33 and a mirror 34, a CCD (Charge Coupled Device) 36 of a color system for outputting electric signals for each color corresponding to the light intensity after receiving the reflected lights from the document 2, a collective lens 37 for collecting the reflected lights from the document to the CCD 36 and a mirror 38 for guiding the reflected lights from the mirror 34 to the CCD 36.

The exposure and scanning section 35 reads the document 2 conveyed by the conveyance roller 23 by moving the document 2 to the read position beneath the slit glass 31 and stopping it, in case when reading the document 2 fed by the automatic document feeder 20. The exposure and scanning section 35 reads a document in a still state placed on the platen glass 32 by scanning the exposure and scanning section 35 from left to right along the under surface of the platen glass 32 when reading the document 2 placed on the platen glass 32.

A printer section 40 includes an image forming section 41, the fixing device 42, a sheet feed section 70 for sheet feeding a sheet and a sheet conveyance section 80 for conveying the fed sheet. The image forming section 41 includes an intermediate transfer belt 43, a plurality of image forming units 50Y, 50M, 50C and 50K for forming respective mono-color toner images of Y, M, C and BK on the intermediate transfer belt 43, a primary transfer member, a cleaning section 44 and a secondary transfer section 45.

The image forming unit 50Y forms a Yellow (Y) color toner image on the intermediate transfer belt 43. The image forming unit 50M forms a Magenta (M) color toner image on the intermediate transfer belt 43. The image forming unit 50C forms a Cyan (C) color toner image on the intermediate transfer belt 43. The image forming unit 50K forms a Black (K) color toner image on the intermediate transfer belt 43.

The image forming unit 50Y includes a cylindrical shaped photoreceptor drum 51Y, onto which an electrostatic latent image is formed, a charging unit 52Y disposed around the photoreceptor drum 51Y, a developing unit 53Y and a cleaning unit 54Y. The image forming unit 50Y further includes a laser unit 55Y structured by a laser diode, a polygon mirror, various lenses and a mirror.

The photoreceptor drum 51Y rotates in an arrow A direction by being driven by a drive section. The charging unit 52Y evenly charges the photoreceptor drum 51Y. The laser unit 55Y irradiates laser beams, which is turned on and off corresponding to the Yellow colored image data, onto the photoreceptor drum 51Y to form the electrostatic latent image thereon. The developing unit 53Y forms a toner image by developing electrostatic latent using Yellow colored toner. This toner image is transferred onto the intermediate transfer belt 43 at the primary transfer position. The cleaning unit 54Y removes and collects the residual toner remaining on the surface of the photoreceptive drum 51Y by using a blade after the transfer.

The image forming units 50M, 50C and 50K have the same structure as the image forming unit 50Y except that the laser beams are to be turned on and off by the corresponding image data of respective colors. Symbols M, C and K are given to the corresponding structural elements instead of the symbol Y even though the number portions are the same.

The intermediate transfer belt 43 is supported so as to be capable of rotating around a plurality of rollers. The intermediate transfer rollers 43 rotate in an arrow B direction by being driven by a drive section. On the rotating process, the toner image of each color formed by the image forming units 50Y, 50M, 50C and 50K is formed onto the intermediate transfer belt 43 in the order of (Y), (M), (C) and (K). This color toner image is transferred onto the sheet from the intermediate transfer belt 43 (secondary transfer) at once in the secondary transfer member 45 provided in lower edge of a circuit path of the intermediate transfer belt 43. After the secondary transfer, the cleaning section 44 removes the toner remaining on the intermediate transfer belt 43.

The fixing device 42 includes a fixing belt 421, which is a fixing member, a fixing roller 421*a* and a stretching roller 421*b* for stretching the fixing belt 421 and a pressing roller 423, which is a pressing member. Further, the fixing device 42 sandwiches the sheet P, onto which a toner image is transferred, with the fixing roller 421*a* and the pressing roller 423 via the fixing belt 421 and fixes the toner onto the sheet P by applying heat and pressure. The sheet P ejected from the fixing device 42 is ejected outside the apparatus or conveyed to a reversing path 80*b*. The fixing device 42 will be described in detail later by referring to FIGS. 2(*a*)-2(*b*).

Sheet feed section 70 includes a plurality of sheet feed trays 71 for storing different sheet sizes and sheet types. In the downstream side of each sheet feed tray 71, a first sheet feed roller 72 for feeding the sheet stored on the top of the sheet feed tray 71 to a conveyance section 80 is provided. Further, in downstream side of each sheet feed tray 71, a sheet feed tray 73 for detecting the fed sheet is provided.

The conveyance section 80 includes a normal path 80*a* for sheet feeding the sheets conveyed from the sheet feed tray 71 through the secondary transfer member 45 and the fixing device 42 and ejecting the sheets outside the apparatus, and a reverse path 80*b* for reversing the sheets passed through the fixing device 42 and merging the sheets into the normal path 80*a* in the upstream of the secondary transfer member 45. The respective paths 80*a* and 80*b* include a plurality of conveyance rollers 81 with a distance, which is shorter than the size in the conveyance direction of the minimum sheet size.

A leading edge detecting sensor 82 for detecting the leading edge of the sheet is provided in the upstream of the secondary transfer member 45 in the conveyance section 80. Further, a registration roller 83 is provided in the upstream side. Further, in the upstream side of a registration roller 83, a second sheet feed sensor 84 for detecting the arrival of the sheet is provided.

The sheet fed from the sheet feed tray 71 hits the registration roller 83 and pauses. Then the conveyance is resumed thereafter. The sheet, onto which an image has been formed, is ejected outside the image forming apparatus 10.

[Fixing Device]

Next, the schematic structure of the fixing device 42 pertaining to an embodiment of the present invention will be described by using FIGS. 2(*a*)-2(*b*).

The fixing roller 421*a* in the fixing device 42 is disposed against the pressing roller 423.

The fixing roller 421*a* includes a heat source 422 structured by two halogen lamps inside, and functions as a heating section on the fixing process. Further, the both ends of a pressing roller 423, which is a pressing member, are supported by the concave section 424*a* of a first arm 424 and the pressing roller 423 can pressure contact or be released from the fixing belt 421 by swinging the first arm 424 around the swing shaft 424*b* (C1 and C2 directions in FIG. 2(*a*)).

One end of the swing shaft 426*a* is pivotally supported by the second arm 426 in the center section of the first arm 424. The second arm 426 swings around the swing shaft 426*a* by being pushed by a cam 427. Further, a pressing spring 425 is arranged between the edge sections, which is opposite side of the swing shaft 424*b* of the first arm 424 against the swing shaft 424*b* and the edge section, which is opposite side of the of the second arm 426 against the swing shaft in the second arm 426. Meanwhile, the cam 427 is arranged to be driven by a motor (not shown).

The pressing method of the fixing device 42 is as follows. Namely, in case when the second arm 426 is rotated in the sheet conveyance path direction (in the C1 direction (counterclockwise) in FIG. 2(*b*)) by being pressed by the cam 427, the pressing spring 425 moves in the sheet conveyance path side. In accordance with this movement, also the first arm 424 rotates counterclockwise and firstly, the pressing roller 423 contacts the fixing roller 421*a*. Further, in case when the cam 427 continues to rotate and further presses the second arm 426, the nip portion of the pressing roller 423 and the fixing roller 421*a* is pressed while being deformed by the pressing force of the pressing spring 425. Meanwhile, the sheet, onto which a toner image has been transferred but not fixed yet (not shown), moves from right to left in FIGS. 2(*a*) and 2(*b*) and passes through the nip portion of the fixing roller 421*a* and the pressing roller 423. Then, a toner image is melted and fixed onto the sheet.

Meanwhile, the releasing method of the pressing of the fixing device 42 is as follows. The state shown in the FIG. 2(*a*) can be shifted to the state shown in the FIG. 2(*b*) by swinging the second arm 426 to the opposite direction (C2 direction in FIG. 2(*a*)) of the sheet conveyance path side by the cam 427. Based on this operation, the pressing spring 425 is extended and the edge section of the first arm 424 is lowered from the position "X" shown in a dotted line to the position "Y" apart from the position "X" by distance d, which is shown in a solid line. The pressing roller 423 held by the first arm 424 is separated from the fixing roller 421*a*.

[Control]

Next, the controller and the schematic structure of each section of the image forming apparatus 10 pertaining to the embodiment in FIG. 3 will be described.

The image forming apparatus 10 includes the controller 60 shown in FIG. 3, a memory section 92, I/F (interface) 91, a display and operation section 93 and a counting section 94.

The interface 91 receives the document data transmitted from an external terminal U via network 100 and stores the document data to the memory section 92. With respect to the network 100, for example, LAN (Local Area Network) is listed.

The controller 60 is configured by a CPU (Central Processing Unit), a ROM (Read Only Memory) and RAM (Random Access Memory). In the memory section 92, a control program has been stored in advance. The CPU extends the control program on the RAM when necessary and executes the control. Practically, there are conducted a reading control, a transmission and reception control, an image processing control, a counting control, a sheet feed control, a display control, a cleaning mode execution control and a sheet feed control. Each process and control will be described later. The memory section 92 stores image data and display image data to be displayed on the display section 93*b*.

The memory section 92 stores the image data received from the interface 91. Further, the memory section 92 stores the document data read from the reading section 30. The controller 60 image processes the stored document data, which will be stored in the memory section 92.

A display operation section 93 is configured by an operation section 93*a* and a display section 93*b*. With regard to the operation section 93*a*, for example, a touch panel, which is a display and an input device, is used and has roles of a display function and an input function. The operation section 93*a* includes an operation device, such as button. The operation section 93*a* and display section 93*b* may be combined.

The counting section 94 has a counting function and transmits the counting signal of the controller to each control of the controller 60 (a sheet feed control, an execution control of a cleaning mode, a sheet feed control and a counting process), which will be described later, to the controller 60. This counting signal denote a signal used for an execution control of the cleaning mode, which will be described later, and the time measurement of the time used for the sheet feed control.

Here, each process and the each control of the controller 60 in the image forming apparatus 10 of the embodiment will be described hereinafter.

[Control of each Section]

The controller 60 executes the control of automatic document feeder 20 and the reading section 30, the transmission and reception of the document data, and a compression process and an extension process of the document data stored in the memory section 92.

[Sheet Feed Control]

The sheet feed control by the controller 60 controls the sheet conveyance start timing for conveying the sheet from the registration roller 83 to the secondary transfer member 45 in case of image formation. This sheet conveyance timing is adjusted based on the detection of the sheet P1 by a second sheet feed sensor 84, the conveyance speed of the sheet P1 by the registration roller 83 and the distance to the fixing device 42 from the registration roller 83.

[Display Control]

The display control by the controller 60 displays the display screen for the operator to set the items of the jobs related to the document or other items on the display section 93*b*. The items of job denotes, for example, items of the sheet related to the output image data (magnification, reduction ratio, a sheet direction, an output sheet, a sheet feed tray), an output order, an output method and a post process. Other items denote, for example, the execution of the cleaning mode for cleaning the fixing device 42 and the selection of the execution.

There is a selection of the execution of the cleaning mode after the occurrence of sheet jam as an example of the selection of the execution of the cleaning mode. The controller 60 detects an malfunction operation of the conveyance roller 81 and the fixing device 42 (for example, the status where the conveyance process to the normal path 80*a* and the reverse path 80*b* by the conveyance roller 81 cannot be executed) in case when sheet jam occurs in the fixing device 42 and determines whether sheet jam occurs based on this detection. In this case the controller 60, for example, reads out the data of the display screen for displaying a resolution method for resolving the sheet jam from the memory section 92 and display it on the display section 93*b*. In case when the operator has resolved the sheet jam in response to the display screen displayed on the display screen, the controller 60 detects sheet jam clearing.

In case when the controller 60 detects the sheet jam clearing, the controller 60 reads out the display data of the selection screen for selecting the execution of a cleaning mode from the memory section 92. This selection screen will be described by referring to FIG. 4.

Figure 4:
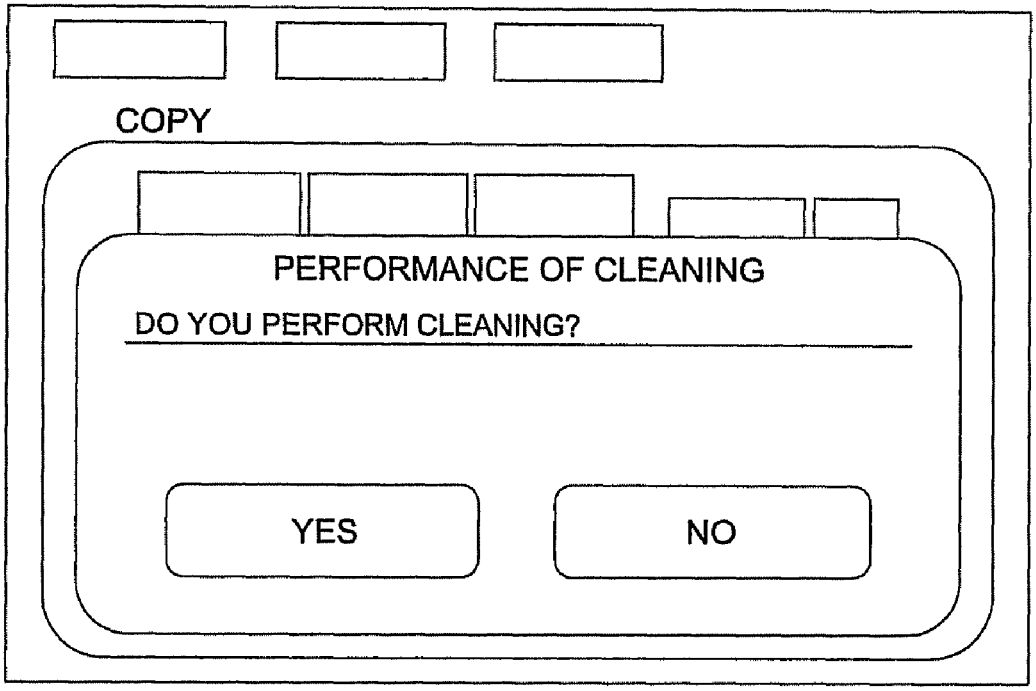
FIG. 4 illustrates an execution selection screen of a cleaning mode of the image forming apparatus pertaining to the embodiment of the present invention.

FIG. 4 illustrates a selection screen of a cleaning mode. The operator can select an execution of the cleaning mode or non-execution, which will be described later, through the cleaning mode selection screen by using the operation section 93*a*.

Namely, in case when the operator selects the execution key of the selection screen illustrated in FIG. 4, the controller 60 executes the cleaning mode. Meanwhile, in case when a non-execution key N is selected, the controller 60 does not execute a cleaning mode. The selection in the cleaning mode selection screen is not limited to the timing after the controller 60 has detected the sheet jam clearing. The controller 60 may be configured so that the operator can execute the selection at an arbitrary timing by using the display operation section 93.

[Execution Control of Cleaning Mode]

In the execution control of the cleaning mode by the controller 60, the cleaning of the toner dirt adhered on the fixing device 42 is executed by conducting the sheet feed of a blank sheet in response to the request of the execution of the cleaning mode on the selection screen. This execution control of the cleaning mode will be explained by using FIGS. 5(*a*)-5(*b*). FIG. 5(*a*) illustrates the situation where the sheet P1 has arrived in front of the nip portion of the fixing device 42 under the execution control of the cleaning mode. Further, FIG. 5(*b*) illustrates the situation where the cleaning of the fixing device 42 is executed under the execution control of the cleaning mode.

The controller 60, as the execution control of the cleaning mode, controls the sheet conveyance timing, by which the sheet P1 arrives at the fixing device 42 under the control of registration roller 83. The sheet conveyance timing of sheet P1 is determined based on the conveyance speed of the sheet P1, the distance L1 (refer to FIGS. 5(*a*)-5(*b*)) and the detection of the sheet P1 by the sensor.

The controller 60 measures the conveyance timing of sheet P1 and conveys the sheet P1 to the secondary transfer member 45. Under the execution control of the cleaning mode, the transfer of a toner image onto the sheet P1 arrived at the secondary transfer member 45 is not conducted. Namely, in case of image formation, a toner image is formed onto the intermediate transfer belt 43 by the image formation units 50Y, 50M, 50C and 50K and the toner image is transferred onto the sheet P1 passing through the secondary transfer member 45. In case when conducting the execution of the cleaning mode, the controller 60 controls image formation units 50Y, 50M, 50C and 50K not to form the toner image. Thus, the toner image is not transferred onto the intermediate transfer belt 43, further the toner image is not transferred onto the sheet P1, even the sheet P1 passes through the secondary transfer section 45 and the sheet P1 is conveyed to the fixing device 42 in a blank sheet condition.

Further, under the execution control of the cleaning mode by the controller 60, as illustrated in FIG. 5(*a*), prior to the arrival of the sheet P1 to the fixing device 42, the controller 60 controls the pressing roller 423 of the fixing device 42 so as to be away from the fixing roller 421*a* to release the pressing state in the fixing device 42.

Namely, the controller 60 releases the pressure of the fixing device 42 when a first time period has passed from the time when the registration roller 83 started the conveyance of the sheet P1.

This first time period corresponds to the a time period, for which the sheet P1 needs to reach in front of the nip portion of in the fixing device 42 from the registration roller 83. This first time period can be obtained from the distance L1 from the registration roller 83 to the place, which is in front of the nip portion (refer to FIGS. 5(*a*)-5(*b*)), and the conveyance speed of the registration roller 83, which has been stored in the memory section 92 in advance. As described above, since the controller 60 releases the pressure of the fixing device 42 prior to the arrival of the sheet P1 to the nip portion of the sheet P1 and the leading edge of the sheet P1 passes in the released state, it is prevented that the leading edge of the sheet P1 is wound around the fixing device 42 by the residual toner, and further the occurrence of sheet jam under the execution of the cleaning mode can be prevented. Thus, even though the melted residual toner and the conveyed sheet P1 arrive at the nip portion at the same time, since the fixing device 42 has been released (FIG. 5(*b*)) and at least the leading edge of the sheet passing through the fixing device 42 is able to pass without being pressed. Accordingly, the effects of the stiffness of the sheet P1 prevent the melted toner from adhering onto the sheet P1. Further, the effects of the stiffness of the sheet P1 prevent the situation where the sheet P1 is wound from occurring. Thus, the occurrence of the sheet jam in case when cleaning the toner dirt on the fixing belt 421 can be avoided.

Further, in the execution control of the cleaning mode, the controller 60 releases the pressure of the fixing device 42 prior to the arrival of the sheet P1 to the nip portion of the fixing device 42 and controls the fixing device 42 to resume in a pressured state after the leading edge of the sheet P1 has passed through the nip portion.

Namely, the controller 60 controls the fixing device 42 so as to resume to be in the pressured state after a second time period has passed, which is a period from the time when the pressure of the fixing device 42 has been released to the time when the leading edge of the sheet P1 has passed through the nip portion.

In this embodiment, the controller 60 controls the fixing device 42 to resume to be in the pressured state after the time period has passed, which is obtained by adding the first and the second time periods, from the starting time when starting the conveyance of the sheet P1 from the registration roller 83. However, it also may be possible that the fixing device 42 resumes to be in the pressured state after the second time period has passed from the starting time when the controller 60 releases the pressure of the fixing device 42.

The second time period denotes a time period obtained by diving the distance L2 (FIGS. 5(*a*) and 5(*b*)), which is a distance from in front of the nip portion (the position where the controller 60 releases the pressure of the fixing device 42) to the position where the leading edge of the sheet P1 has passed the nip portion, by the conveyance speed of the sheet P1. The position where the leading edge of the sheet P1 has passed is preferably, for example, the position where the leading edge of the sheet P1 is not less than 10 mm away from the nip portion. With this distance, the leading edge of the sheet P1 will not be wound and it becomes possible for the sheet to conduct cleaning in a wider portion.

As describes above, by resuming the fixing device 42 to the pressured state, the sheet P1 passing through the nip portion of the fixing device 42 passes through the nip portion under the pressured state and the residual toner adhered onto the fixing belt 421 moves onto the sheet P1. As a result, the residual toner is removed from the fixing belt 421. Thus, the toner dirt of the fixing device 42 can be resolved.

Further, controller 60 preferably controls the switching of the pressure and the release based on the thickness of the sheet P1 used for the cleaning mode. For example, the controller 60 determines the thickness of the sheet P1 based on the sheet information inputted by the operator, for example, the nominal weight.

The controller 60 determines whether the thickness of the sheet P1 is within a prescribed thickness and releases the pressure only when the thickness is not more than the prescribed thickness. In case when the thickness is more than the prescribed thickness, it is preferred not to conduct the switch.

This prescribed thickness denotes a thickness of normal sheet. For example, the prescribed thickness is a thickness when the nominal weight of the sheet is 200 g/m$^2$.

In case of the sheet having the nominal weight is more than 200 g/m$^2$, even though the release of the pressure of the fixing device 42 is not executed, the leading edge of the sheet P1 reaches to the nip portion of the fixing device 42 and the residual toner adheres the leading edge of the sheet. Since the stiffness of the sheet is strong, the leasing edge of the sheet will not be wound. Thus, sheet jam does not occur in the cleaning mode.

(Sheet Refeed Control)

When the entire fixing belt 421 cannot be cleaned in response to the length of the sheet P1, the controller 60 executes a sheet re-feed control, which cleans by the first sheet P1 and the following sheet P2.

The controller 60 in the sheet re-feed control obtains the range of the fixing belt 421, which has not been cleaned in the sheet feeding of the first sheet P1, and executes the following process in order to re-execute a cleaning mode on non-cleaned area.

A length of the circumference of the fixing belt 421, which is stored in a memory section 92 in advance, and a length L3 of the conveyance direction drawn from the size of the sheet P1 used in the cleaning mode (refer to FIG. 6) are compared. As a result, when the length L3 of the sheet P1 is less than a length L4 of the fixing belt 421, the sheet re-feed control is executed by the following sheet P2. The length of the circumference, for example, is the length of an area A1 and area A2 combined in FIG. 6.

When the length of the sheet P1 is less than the length L4 of the fixing belt 421, the controller 60 executes the sheet re-feed control. In case when the sheet re-feed control of the cleaning mode re-executed, a control of the sheet conveyance start timing of a following sheet P2 from the registration roller 83 is executed.

Figure 6:
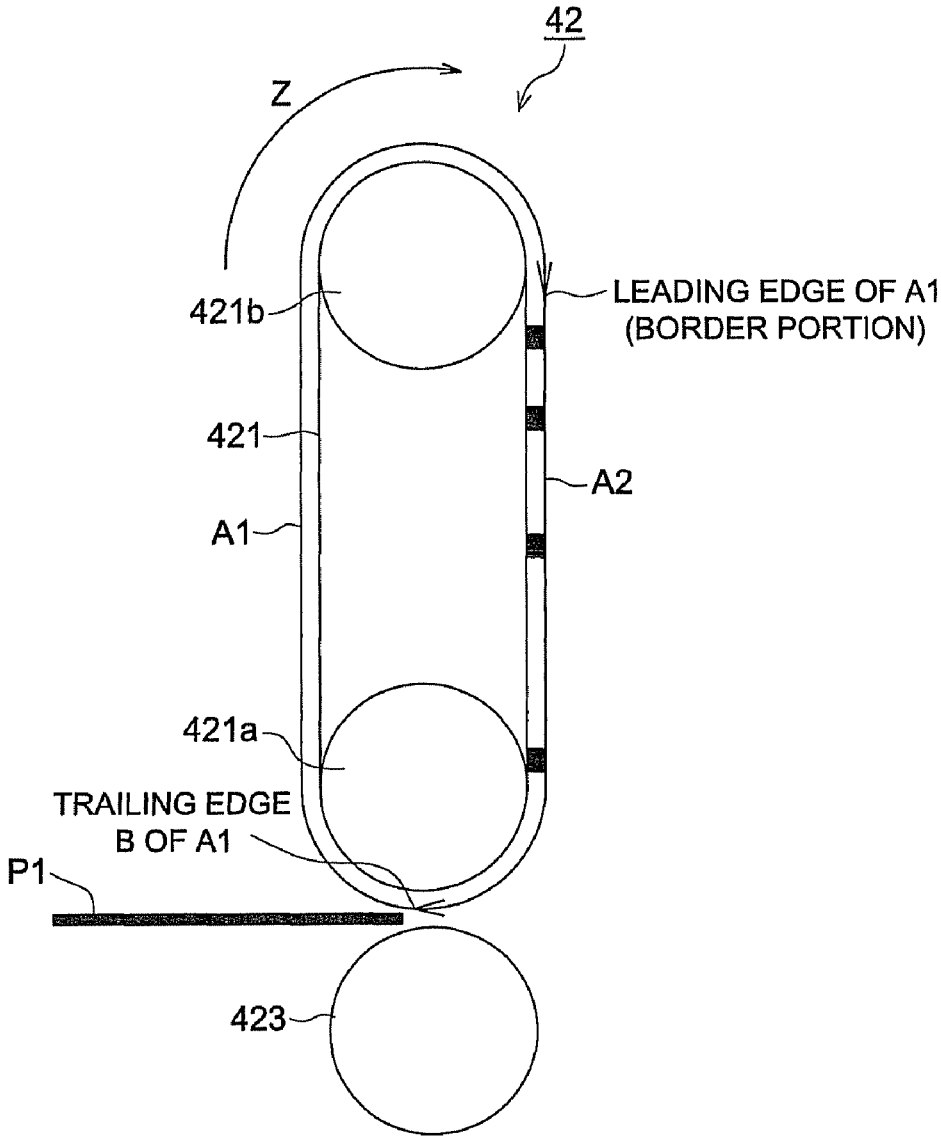
FIG. 6 illustrates a schematic drawing of a fixing device of the image forming apparatus pertaining to the embodiment of the present invention.
Figure 7:
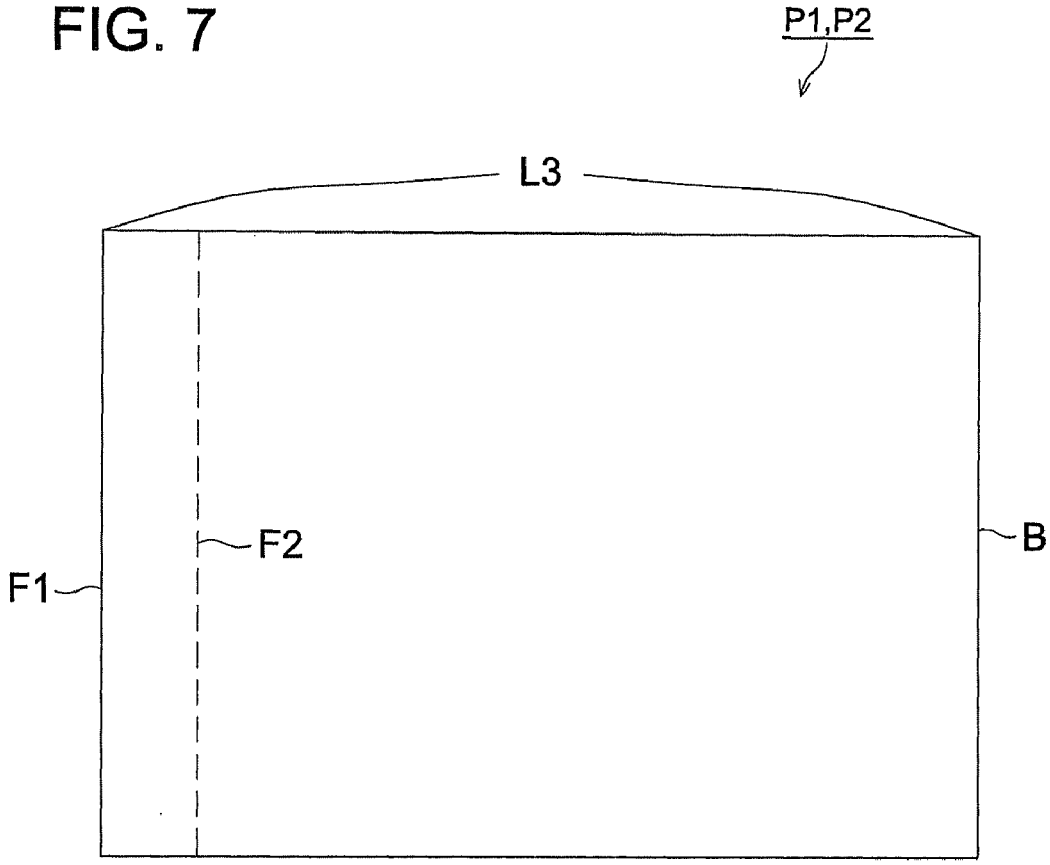
FIG. 7 illustrates a schematic diagram showing a sheet utilized for the sheet feed based on the execution of the cleaning mode.

The sheet conveyance start timing denotes a timing to start the conveyance of the sheet P2 from the registration roller 83 in order to have a leading edge of the sheet P2 passing through the nip portion at the same time with a section, which the cleaning of the fixing belt 421 should start, reaching the nip portion. The sheet conveyance start timing of the sheet re-feed control in the controller 60 will be explained using FIG. 6. FIG. 6 illustrates a schematic drawing of the fixing belt 421, the pressuring roller 423 and the sheet P1 in the fixing device 42. FIG. 7 illustrates a plan view showing the sheet P1.

When the length L3 of the first sheet P1 (refer to FIG. 7) is less than a length of the fixing belt 421, the fixing belt 421, which cleaning is executed by the first sheet P1, is divided into a cleaned area A1 and non-cleaned area A2. Here, a sheet feeding by the cleaning mode of a following sheet P2 will clean the non-cleaned area A2 by the following sheet P2. Therefore, in case when the leading edge of the following sheet P2 reaches the nip portion, the sheet conveyance timing conduct a contact at a boundary section between the cleaned area A1 and the non-cleaned area A2 of the fixing belt 421. Further, it is preferred to have a contact at the cleaned area A1 side (Z direction side in FIG. 6) from the border portion, and to have a part of the cleaning area of the sheet P1 and P2 overlap. When a cleaning is executed by the following sheet P2, it is possible to avoid having a gap in the border portion of a following edge of the cleaned area Al and the leading edge of the non-cleaned area A2, and prevent an omission of the cleaning by overlapping parts of the cleaning area of the sheet P1 and P2.

Namely, the sheet conveyance start timing for the following sheet P2 is set as follows.

The controller 60 divides the length L3 of the sheet conveyance direction of the sheet P1 by the sheet conveyance speed of the registration roller 83 and stores memory of the third time period needed for the sheet P1 to pass through the nip portion to the memory section in advance.

Further, the controller 60 divides the length L4 of the fixing belt 421 by a rotation speed of the fixing belt 421 and stores memory of the fourth time period needed for the fixing belt 421 to make a full turn to the memory section in advance.

The controller 60 obtains the fifth time period by adding the fourth time period to the third time period stored in memory section in advance. The sheet conveyance start timing, which starts the sheet conveyance of the following sheet P2 from the registration roller, is considered to be after the fifth time period has passed based on the time of starting the sheet conveyance of the first sheet P1 from the registration roller.

Further, also in the sheet re-feed control, the controller 60 executes the switching control of pressuring and the releasing of the fixing device 42. The switching controller is as is mentioned above, therefore, the explanation will be omitted.

By controlling in this way, the cleaning of the outer circumference section of the fixing belt 421 is executed. Therefore, a complicated operation, where an operator determines the existence of the omission of the cleaning of the fixing device 42, can be avoided.

Further, when the non-cleaning area is determined to be present in the outer circumference section of the fixing belt 421 after the first cleaning mode has been executed, the controller 60 executes the sheet re-feed control. Thus, even when the cleaning of the residual toner of the fixing device 42 is not completed by the first sheet, the sheet feeding is executed by repeating the cleaning mode with the second sheet. Therefore, the omission of the cleaning of the fixing device by the sheet feeding is avoided, and the sheet feeding is efficiently executed by the execution of the cleaning mode.

Figure 8:
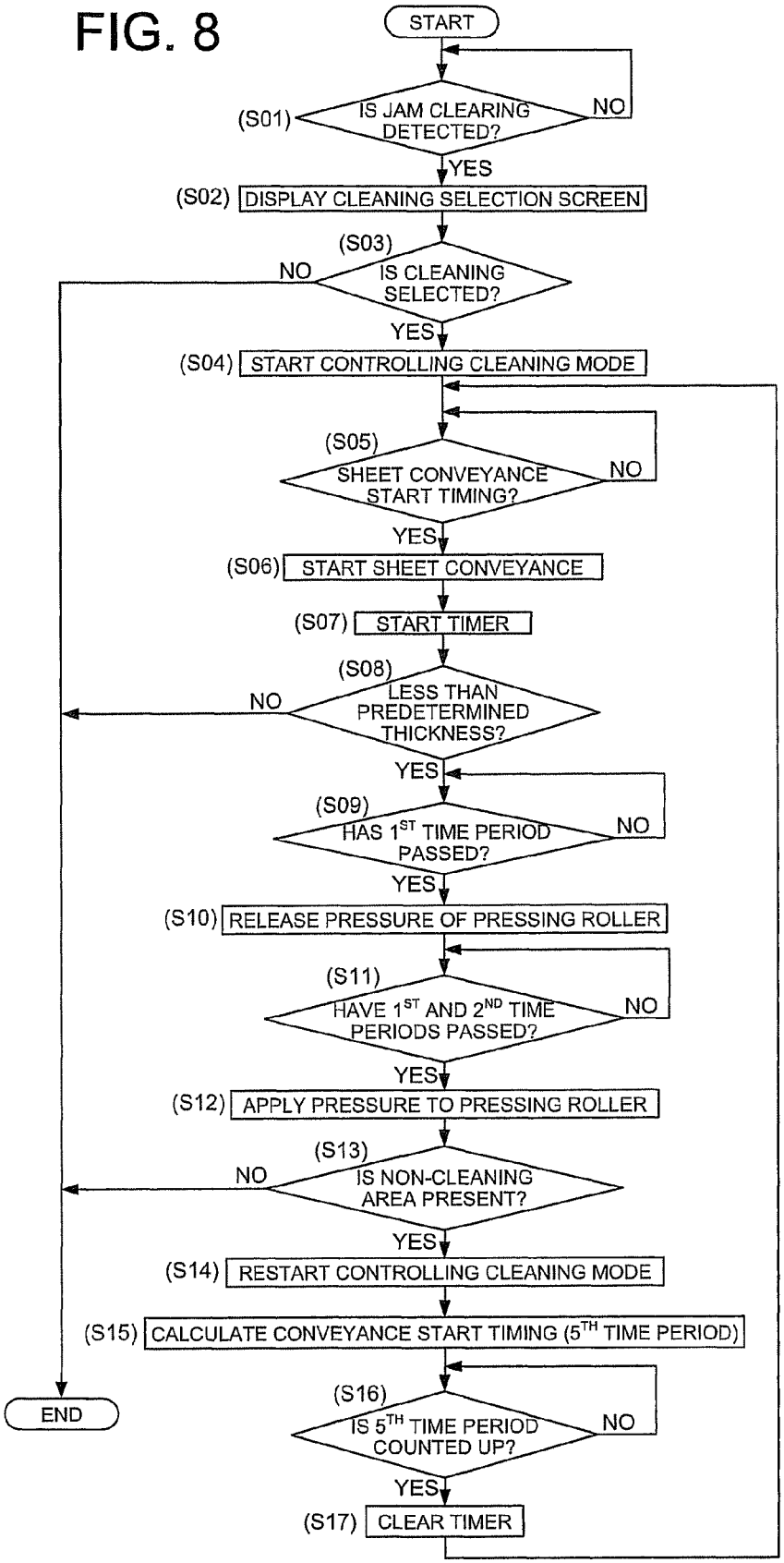
FIG. 8 illustrates a flowchart showing a series of operations of the image forming apparatus in case when receiving an execution instruction of the cleaning mode of the image forming apparatus pertaining to the embodiment of the present invention.
Figure 9:
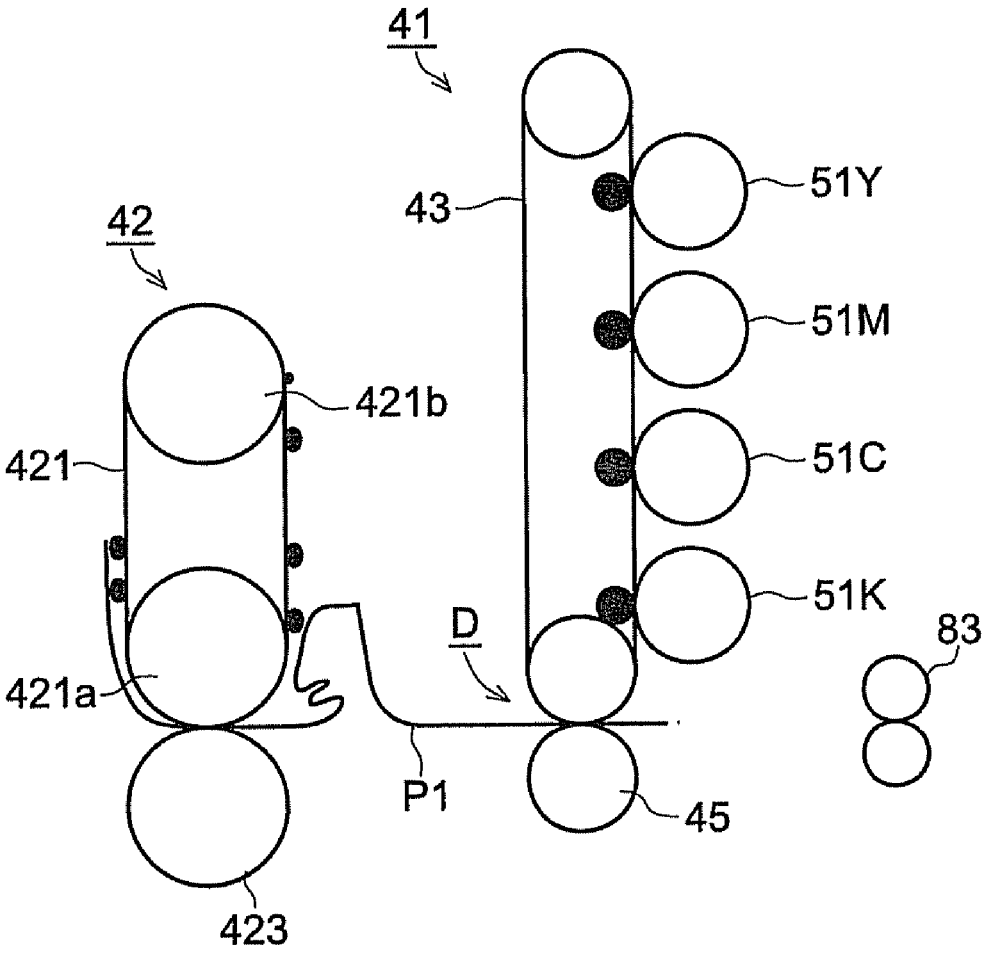
FIG. 9 illustrates a schematic cross sectional view showing the sheet stuck in the fixing device of the printer section and the printer section in a conventional image forming apparatus.
Figure 10:
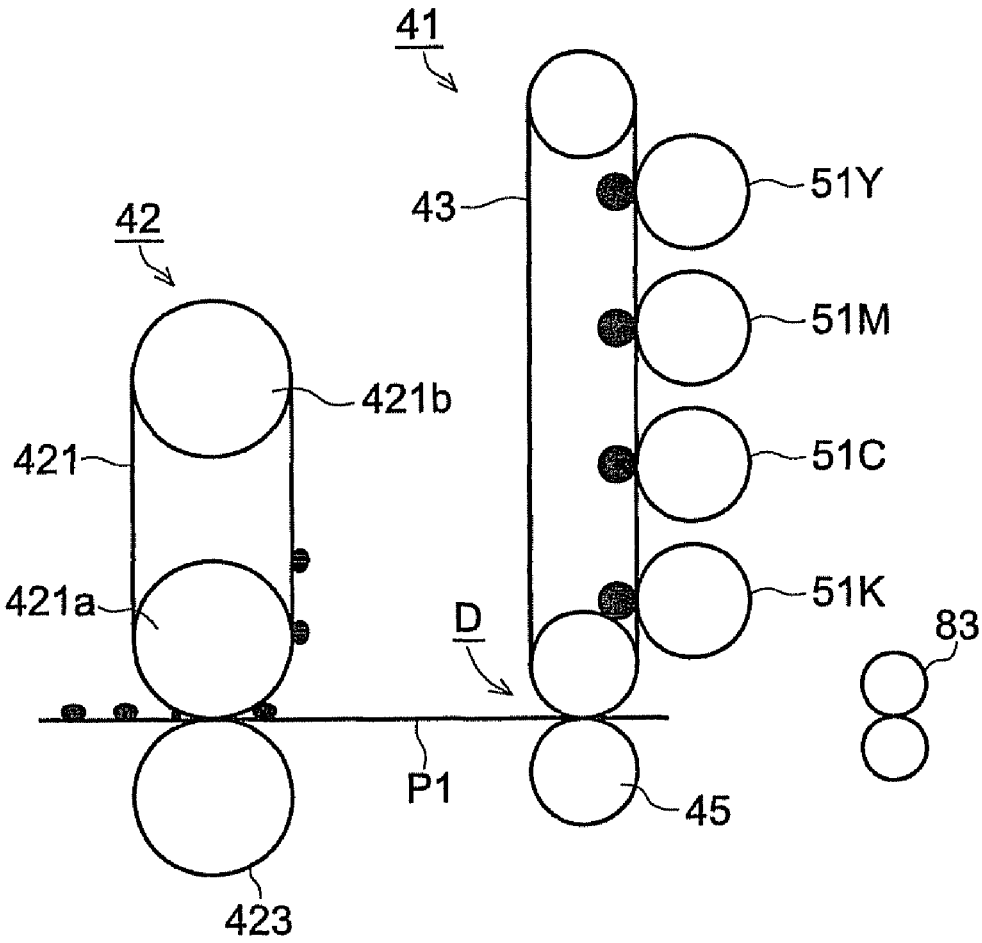
FIG. 10 PRIOR ART
FIG. 10 illustrates a schematic cross sectional view showing a situation of the sheet feed being executed based on the execution of the cleaning mode in the printer section in a conventional image forming apparatus.
Figure 11:
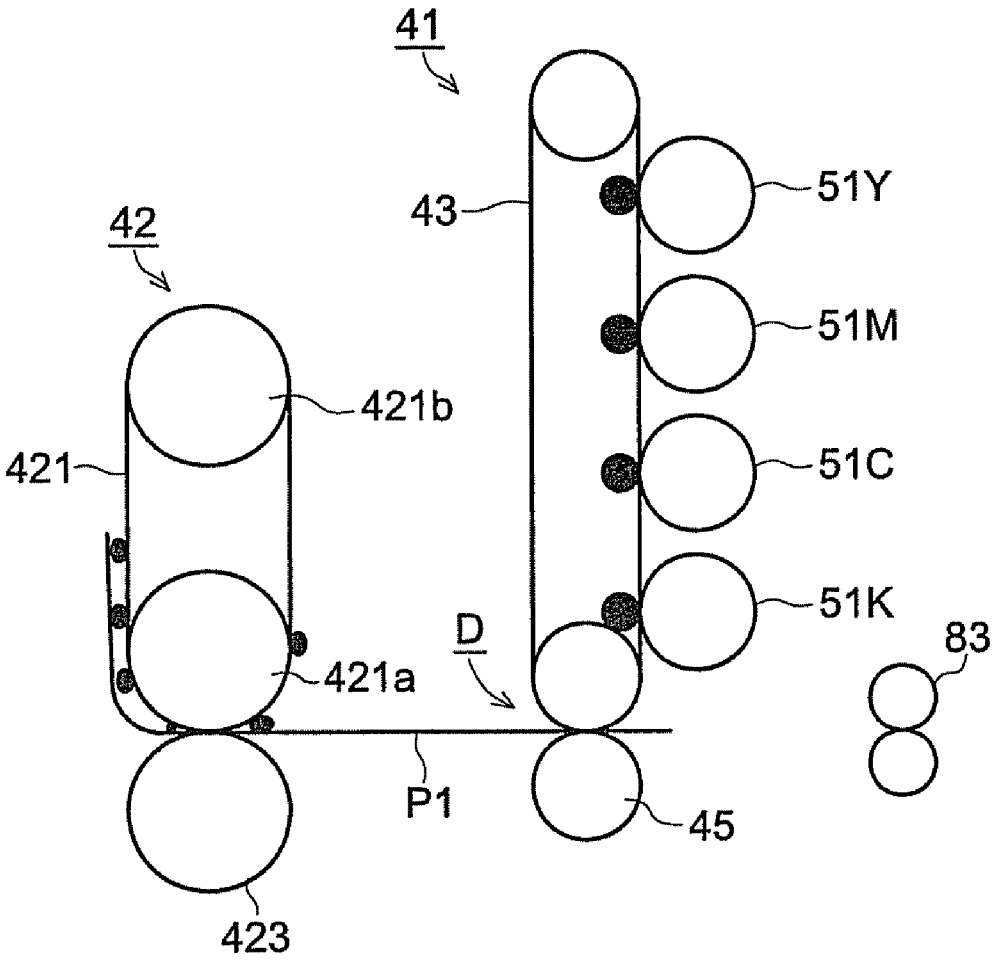
FIG. 11 illustrates a schematic cross sectional view showing the sheet wound in the fixing device of the printer section and the printer section in the image forming apparatus.

Next, a flow of the execution of the cleaning mode in the image forming apparatus 10 of the embodiment of the present invention is explained by using a flow chart illustrated in FIG. 8.

The controller 60 determines the sheet jam clearing after the occurrence of the sheet jam in the fixing device 42 (S01). When the sheet jam clearing is detected (S01: YES), the controller 60 displays a selection screen for the execution of the cleaning mode (refer to FIG. 4) on an operation section 93*a* (S02). In the selection screen, the determination is made whether the execution has been selected by an operator or not (S03). When the execution is selected (S03: YES), the controller 60 starts controlling the cleaning mode (S04). Meanwhile, when the execution was not selected by the operator (S03: NO), the flow is terminated, and the cleaning mode will not be executed.

The controller 60 starts controlling of the cleaning mode in STEP 04 (S04).

Firstly, the controller 60 determines if it has reached the sheet conveyance start timing (S05).

When it is determined not to have reached the sheet conveyance start timing (S05: NO), the controller 60 repeats the determination of STEP S05. When it is determined to have reached the sheet conveyance start timing (S05: YES), the registration roller 83 is controlled and the sheet conveyance of the sheet P1 is started (S06). Further, a timer is started based on the sheet conveyance starting timing.

Next, the controller 60 determines whether a thickness of the sheet P1 used to execute the cleaning mode is less than a prescribed thickness or not (S08). The determination of the prescribed thickness is made based on, for example, the data of the information of a sheet, such as, the size of the sheet P1 and a nominal weight of the sheet, inputted by an operator. For example, the determination is made based on whether the nominal weight of the sheet P1 is less than 200 g/m$^2$.

When the sheet P1 is determined to be not less than the prescribed thickness (S08: NO), the controller 60 sheet feeds the sheet P under the pressured state without switching the pressure and release of the fixing device 42, and terminates the flow.

When the sheet P1 is determined to be less than the prescribed thickness (S08: YES), the controller 60 determines whether the time of the timer has become the first time period or not (S09). The first time period denotes the time from the point of the start of the sheet conveyance of the sheet P1 from the registration roller 83 up to the point of the leading edge of the sheet P1 to reach before the nip portion of the fixing section 42, and is the release timing for releasing the pressure. When the first time period has determined not to have passed (S09: NO), the controller 60 repeats the determination until the first time period passes.

When it is determined that the first time period has passed (S9: YES), and a release timing of the pressure of the fixing device 42 has arrived, the controller 60 puts the cam 427 of the fixing device 42 in drive and releases the pressure of the fixing device 42 after a pressuring roller 423 is separated from a fixing roller 421*a* via the second arm 426 and the first arm 424 (S10).

Next, the controller 60 determines whether the time, which the first time period and the second time period has combined, has passed (S11). The second time period denotes the time from the releasing point of the pressure of the fixing device 42 up till a point of the first sheet reaching the nip portion, which the sheet P1 passes through. The pressuring point is from a point of the release of the pressure to a point of the distance L2 after the sheet P1 passes through the nip portion. Since a timer is counting a time from the point of the start of the sheet conveyance, a time, which the first time period and the second time period has combined, becomes the timing for pressuring. When time, which the first time period and the second time period have been combined, is determined to have not passed (S11: NO), the controller 60 repeats the determination. When time, which the first time period and the second time period have been combined, is determined to have passed (S11: YES), the controller 60 puts the cam 427 of the fixing device 42 to drive, and the pressuring roller 423 is pressured onto the fixing roller 421*a* again via the second arm 426 and the first arm 424 (S12). After the pressuring roller has been pressured, the cleaning mode is executed while the sheet P1 is in the state of being closely attached to the fixing belt 421.

Next, the controller 60 determines whether there is a non-cleaning area present on the fixing belt 421 or not (S13). When the length L3 of the first sheet P1 utilized in the execution of the cleaning mode is less the length L4 of the fixing device, it is determined that the non-cleaning area is present (S13: YES). When the non-cleaning area is determined to be present (S13: YES), the controller 60 restarts the controlling of the cleaning mode by the second sheet P2 (S14). The controller 60 calculates the fifth time period, which is the sheet conveyance start timing of the following sheet P2, by adding the fourth time period needed to circuit around the fixing belt 421 and the third time period, needed to convey the length L3 of the sheet conveyance direction of the first sheet P1 based on the sheet conveyance start timing of the first sheet P1 from the registration roller 83 (S15). The timing is a combination of a timing that a following edge B of an area A1 cleaned by the first sheet P1 reaches to the nip portion again and a timing that a following sheet P2 reaching the nip portion. Next, the determination of whether the timer has counted up the fifth time period or not (S16). When the timer has not counted up the fifth time period, the determination of S16 is repeated (S16: NO). When the timer has counted up the fifth time period (S16: YES), the timer is cleared (S17), and returns to the STEP 06. The same controlling flow mentioned above is executed hereinafter.

A function and an effect of an image forming apparatus, which is related to the embodiment explained above, will be explained.

The image forming apparatus 10 related to the embodiment of the present invention is structured to release the pressure of the fixing device 42 before the sheet P1 and P2 reaches the nip portion of the fixing device 42 by the controller 60 in response to the execution order of the cleaning mode from the operator.

Accordingly, when the sheet feeding is executed by the cleaning mode in the image forming apparatus 10, the sheet reaches the nip portion of the fixing device 42 after the sheet conveyance from the registration roller 83. Even when the residual toner left on the fixing belt 421 and a leading edge F1 (refer to FIG. 7) of the sheet P1 conveyed reaches the nip portion at the same time, the pressure of the fixing section 42 has been released, thus, only a leading edge section of the sheet passes through the fixing device 42 without pressure. And, it prevents the residual toner strongly attached to the leading edge of the sheet P1 to be taken into the fixing belt 421, and the sheet jam can be avoided when a cleaning of the toner dirt on the fixing belt 421 is executed.

Further, when the operator is not in need of cleaning the toner dirt on the fixing device 42, and since the temperature inside of the image forming apparatus 10 is high, the risk of the operator cleaning the inside can be prevented. Further, there is no need to provide a cleaning mechanism around the fixing device 42. The increase of the production cost is not involved, and a wear out and a deterioration of a belt by contact and slide of the cleaning mechanism can be prevented. Also, space inside the image forming apparatus may be conserved.

When the second time period, which the leading edge of the sheet P1 and P2 passes through the nip portion of the fixing device 42 corresponding to the controlling of the cleaning mode by the controller 60, the image forming apparatus 10 relating to the embodiment tries to put back the fixing device 42 under pressure by pressuring the pressuring roller 423 of the fixing device 42 contacted against the fixing roller 421*a*.

Therefore, the pressure of the fixing device 42 is released only at the time when the leading edge of the sheet P1 and P2 passes through. Since the fixing device 42 will be put under the pressure again after the leading edge passes through, the cleaning of toner dirt on the fixing belt 421 can be executed without the occurrence of a sheet jam.

Next, a modified example of the image forming apparatus of the present invention will be described hereinafter.

In the image forming apparatus 10 pertaining to the embodiment described above, the release timing of the pressure of the fixing device 42 is controlled based on the conveyance times of the sheets P1 and P2 from the registration roller 83. However, the present invention is not limited to this embodiment.

For example, the controller 60 controls the fixing device 42 so that the pressure of the fixing device 42 may be released at the timing when detecting the leading edge of the sheet P1 by providing a leading edge detection sensor 82 between the registration roller 83 and the fixing device 42. By releasing the pressure of the fixing device 42 at the timing described above, sine the leading edge of the sheet passes through the fixing device 42 without being pressed, it becomes possible to prevent the sheet to be wound around the fixing device 42 and sheet jam in case of the cleaning mode can be dissolved.

Further, in the image forming apparatus 10 pertaining to the embodiment, the conveyance period of time of sheets P1 and P2 control the timing of allowing the fixing device 42 to resume the pressing state. However, the present invention is not limited to this embodiment.

For example, the resume timing to the pressing state may be controlled based on the detection of the arrival of the leading edges of sheets P1 and P2 by providing the sensor for detecting that the leading edges of sheets P1 and P2. By resuming the pressing state as described above, the leading edges of sheets P1 and P2 can be surely conveyed to the downstream, the winding around the fixing section 42 can be prevented and the sheet jam when feeding a sheet in the cleaning mode can be dissolved.

Further, in the fixing device 42 pertaining to the embodiment, a fixing belt 421 and fixing rollers 421*a* and 421*b* configure the fixing member. However, a heat roller may configure the fixing member.

In the image forming apparatus 10 pertaining to the embodiment of the present invention, the controller 60 is configured to calculate the cleaning area cleaned by the fist sheet P1 based on the length determined by the size of the sheet P1 when the controller 60 executes cleaning by utilizing the second sheet P2. However, the present invention is not limited to this embodiment.

For example, by providing the sensor for detecting the residual toner in the circumference of the fixing device 42, the controller 60 may check the cleaning are by the sheet P1 and the area, which has not cleaned, and control the conveyance timing of the second sheet P2.

In this embodiment, the controller is configured to release the pressure of the fixing device before the leading edge reaches to the nip portion of the fixing member and presses the fixing member after the leading edge has passed through the nip portion, in case when the controller executes the cleaning mode of the fixing member. Thus, it becomes possible to prevent the leading edge of the sheet, which passes through the fixing member when executing the cleaning mode, to adhere to the fixing member and to be wound around the fixing member in case of the sheet feed in the cleaning mode. Further sheet jam associated with the sheet feed in the cleaning mode can also be prevented. Further, the melted residual toner surely adheres to the sheet and the toner dirt of the fixing member can be removed by pressing the fixing member after the leading edger of the sheet has passed through the nip portion. As a result, the cleaning of the fixing member in the image forming apparatus can be safely and easily executed without the deterioration of the fixing member and increase of the manufacturing cost.

What is claimed is:

1. An image forming apparatus which forms an image on a sheet, comprising:

(a) an image forming section structured to form a toner image on the sheet;

(b) a fixing device comprising:

(1) a fixing member, (2) a pressing member which is brought into pressure contact with the fixing member, and (3) a releasing section structured to bring the pressing member into pressure contact with the fixing member or release the pressing member from the fixing member, wherein the fixing device is structured to fix the toner image onto the sheet by applying heat and pressure at a nip portion between the fixing member and the pressing member;

(c) a registration roller structured to feed the sheet to a transfer position downstream in a sheet conveyance direction; and (d) a controller structured to execute a normal fixing mode in which the toner image formed by the image forming section is fixed by the fixing device, and structured to execute a cleaning mode in which the controller conveys a blank sheet to the fixing device, removes toner that has been adhered to the fixing member to clean, and controls a conveyance of the blank sheet, wherein the controller is structured such that, when the normal fixing mode is executed, the controller controls the releasing section to bring the pressing member into pressure contact with the fixing member before a leading edge of a sheet on which the toner image has been formed reaches the nip portion, and when the cleaning mode is executed, the controller controls the releasing section to release the pressure contact of the pressing member before a leading edge of the blank sheet in the sheet conveyance direction reaches the nip portion, and to bring the pressing member into pressure contact with the fixing member after the leading edge of the blank sheet has passed through the nip portion.

2. The image forming apparatus of claim 1, wherein the controller controls the releasing section to bring the pressing member into pressure contact with the fixing member after an elapse of a prescribed period of time after the sheet passes through the nip portion.

3. The image forming apparatus of claim 1, further comprising a conveyance roller provided downstream of the fixing device in the sheet conveyance direction, wherein the controller controls the releasing section to bring the pressing member into pressure contact with the fixing member after the leading edge of the sheet reaches the conveyance roller.

4. The image forming apparatus of claim 1, wherein in case the cleaning mode is executed, when a thickness of the sheet is not more than a prescribed thickness, the controller releases the pressure contact of the pressing member before the leading edge of the sheet in the conveyance direction reaches the nip portion, and when the thickness exceeds the prescribed thickness, the controller does not release the pressure contact.

5. The image forming apparatus of claim 1, wherein the fixing member is a fixing belt, and wherein in case the cleaning mode is executed, when a length of the sheet in the sheet conveyance direction is less than a length in a circumferential direction of the fixing belt, the controller feeds a succeeding sheet and cleans the fixing belt with the succeeding sheet again.

6. The image forming apparatus of claim 5, wherein in case the succeeding sheet is fed from the registration roller to the fixing device, the controller controls a drive start timing of the registration roller so that the succeeding sheet is fed at a timing when the succeeding sheet comes in contact with a part where a preceding sheet has not come in contact with the fixing belt.

* * * * *